US008454066B2

(12) United States Patent
Slack

(10) Patent No.: US 8,454,066 B2
(45) Date of Patent: Jun. 4, 2013

(54) GRIP EXTENSION LINKAGE TO PROVIDE GRIPPING TOOL WITH IMPROVED OPERATIONAL RANGE, AND METHOD OF USE OF THE SAME

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 167 days.

(21) Appl. No.: 13/003,281

(22) PCT Filed: Jul. 17, 2009

(86) PCT No.: PCT/CA2009/001019

§ 371 (c)(1),
(2), (4) Date: Jan. 7, 2011

(87) PCT Pub. No.: WO2010/006445

PCT Pub. Date: Jan. 21, 2010

(65) Prior Publication Data

US 2011/0109109 A1 May 12, 2011

Related U.S. Application Data

(60) Provisional application No. 61/082,117, filed on Jul. 18, 2008.

(51) Int. Cl.
*E21B 31/20* (2006.01)
*E21B 19/00* (2006.01)

(52) U.S. Cl.
USPC ..... 294/86.24; 294/93

(58) Field of Classification Search
USPC ..... 294/86.16, 86.24, 86.25, 93, 94, 294/96, 119.1, 102.1, 102.2
See application file for complete search history.

(56) References Cited

U.S. PATENT DOCUMENTS

| | | | | |
|---|---|---|---|---|
| 705,724 A | | 7/1902 | Upson | |
| 1,045,728 A | * | 11/1912 | Monsees | 294/86.14 |
| 1,152,195 A | | 8/1915 | Maxwell | |
| 1,505,475 A | * | 8/1924 | Lewis | 294/86.14 |
| 1,825,026 A | * | 9/1931 | Thomas | 294/86.19 |
| 1,843,537 A | | 2/1932 | Bickerstaff | |

(Continued)

FOREIGN PATENT DOCUMENTS

| | | |
|---|---|---|
| CA | 1 242 972 A | 10/1988 |
| CA | 1 285 474 C | 7/1991 |

(Continued)

OTHER PUBLICATIONS

Extended European Search Report mailed Oct. 14, 2011, issued in corresponding European Application No. EP 06 72 1876, filed May 3, 2006, 6 pages.

*Primary Examiner* — Dean Kramer
(74) *Attorney, Agent, or Firm* — Christensen O'Connor Johnson Kindness PLLC

(57) ABSTRACT

A grip extension linkage to provide a gripping tool having radial gripping elements with an improved operational range. The grip extension linkage includes at least one annular body having a central internal bore and an peripheral external surface. There is provided rigid elongated spokes. Spoke guides are provided on the annular body. The spoke guides are in close fitting relation with the spokes to constrain the spokes while allowing them to move radially from a retracted position to an engaged position.

20 Claims, 8 Drawing Sheets

U.S. PATENT DOCUMENTS

| | | | | |
|---|---|---|---|---|
| 2,028,966 | A | 1/1936 | Burns | |
| 2,173,531 | A | 9/1939 | De Long | |
| 2,191,000 | A | 2/1940 | Thomas | |
| 2,292,268 | A | 8/1942 | Gibbons | |
| 2,455,005 | A | 11/1948 | Hall | |
| 2,577,994 | A | 12/1951 | Bendeler | |
| 2,647,431 | A | 8/1953 | Lewis | |
| 2,687,323 | A | 8/1954 | Stohn | |
| 2,953,406 | A | 9/1960 | Young | |
| 3,040,808 | A | 6/1962 | Schramm | |
| 3,131,778 | A | 5/1964 | Emerson | |
| 3,301,588 | A | 1/1967 | Maudinet | |
| 3,527,494 | A | 9/1970 | Young | |
| 3,566,505 | A | 3/1971 | Martin | |
| 3,603,110 | A | 9/1971 | Fredd | |
| 3,697,113 | A | 10/1972 | Palauro | |
| 3,747,675 | A | 7/1973 | Brown | |
| 3,776,320 | A | 12/1973 | Brown | |
| 3,857,450 | A | 12/1974 | Guier | |
| 3,863,961 | A * | 2/1975 | Dinning | 285/39 |
| 3,936,089 | A | 2/1976 | Hoffmeister | |
| 4,044,581 | A | 8/1977 | Meserole | |
| 4,065,941 | A | 1/1978 | Aoki | |
| 4,141,225 | A | 2/1979 | Varner | |
| 4,204,910 | A | 5/1980 | Koshkin | |
| 4,243,112 | A | 1/1981 | Sartor | |
| 4,273,372 | A * | 6/1981 | Sheshtawy | 294/86.15 |
| 4,320,579 | A | 3/1982 | Kinley | |
| 4,327,776 | A | 5/1982 | Meserole | |
| 4,368,911 | A | 1/1983 | Pringle | |
| 4,485,702 | A | 12/1984 | Swan | |
| 4,499,799 | A | 2/1985 | Bordages | |
| 4,524,833 | A | 6/1985 | Hilts | |
| 4,570,673 | A | 2/1986 | Kendrick | |
| 4,640,372 | A | 2/1987 | Davis | |
| 4,685,518 | A | 8/1987 | Claycomb | |
| 4,702,313 | A | 10/1987 | Greenlee | |
| 4,726,423 | A | 2/1988 | Claycomb | |
| 4,800,968 | A | 1/1989 | Shaw | |
| 4,878,546 | A | 11/1989 | Shaw | |
| 4,904,228 | A | 2/1990 | Frear | |
| 5,186,411 | A | 2/1993 | Fanning | |
| 5,190,334 | A * | 3/1993 | Sawdon | 294/207 |
| 5,314,032 | A | 5/1994 | Pringle | |
| 5,616,926 | A | 4/1997 | Shinada | |
| 5,617,926 | A | 4/1997 | Eddison | |
| 5,639,135 | A | 6/1997 | Beeman | |
| 5,671,816 | A | 9/1997 | Tibbitts | |
| 6,056,060 | A | 5/2000 | Abrahamsen | |
| 6,095,583 | A | 8/2000 | Beeman | |
| 6,155,346 | A * | 12/2000 | Aldridge | 166/216 |
| 6,161,617 | A | 12/2000 | Gjedebo | |
| 6,309,002 | B1 | 10/2001 | Bouligny | |
| 6,311,792 | B1 | 11/2001 | Scott | |
| 6,378,399 | B1 * | 4/2002 | Bangert | 81/57.15 |
| 6,390,190 | B2 | 5/2002 | Mullins | |
| 6,431,626 | B1 | 8/2002 | Bouligny | |
| 6,443,241 | B1 | 9/2002 | Juhasz | |
| 6,527,047 | B1 | 3/2003 | Pietras | |
| 6,536,520 | B1 | 3/2003 | Snider | |
| 6,557,641 | B2 | 5/2003 | Sipos et al. | |
| 6,598,687 | B2 | 7/2003 | Eppink | |
| 6,622,796 | B1 | 9/2003 | Pietras | |
| 6,637,526 | B2 | 10/2003 | Juhasz | |
| 6,675,679 | B2 | 1/2004 | Dugan | |
| 6,679,333 | B2 | 1/2004 | York | |
| 6,688,398 | B2 | 2/2004 | Pietras | |
| 6,705,405 | B1 | 3/2004 | Pietras | |
| 6,725,938 | B1 | 4/2004 | Pietras | |
| 6,732,822 | B2 | 5/2004 | Slack | |
| 6,742,584 | B1 | 6/2004 | Appleton | |
| 6,835,036 | B2 | 12/2004 | Paul | |
| 6,843,332 | B2 | 1/2005 | Eppink | |
| 6,874,393 | B2 | 4/2005 | Kile | |
| 6,920,926 | B2 | 7/2005 | York | |
| 6,938,709 | B2 | 9/2005 | Juhasz | |
| 6,976,298 | B1 | 12/2005 | Pietras | |
| 6,994,176 | B2 | 2/2006 | Shahin | |
| 7,004,259 | B2 | 2/2006 | Pietras | |
| 7,021,374 | B2 | 4/2006 | Pietras | |
| 7,024,972 | B2 | 4/2006 | Werner | |
| 7,044,030 | B2 | 5/2006 | Chartier | |
| 7,059,221 | B2 | 6/2006 | Simon | |
| 7,090,021 | B2 | 8/2006 | Pietras | |
| 7,096,764 | B2 | 8/2006 | Dong | |
| 7,140,445 | B2 | 11/2006 | Shahin | |
| 7,165,609 | B2 | 1/2007 | Slack | |
| 7,191,840 | B2 | 3/2007 | Pietras | |
| 7,213,656 | B2 | 5/2007 | Pietras | |
| 7,252,161 | B2 | 8/2007 | Ayling | |
| 7,325,610 | B2 | 2/2008 | Giroux | |
| 7,587,873 | B2 | 9/2009 | Mcsherry | |
| 7,775,572 | B2 | 8/2010 | Slack | |
| 7,896,111 | B2 | 3/2011 | Slack | |
| 7,909,120 | B2 | 3/2011 | Slack | |
| 2001/0042625 | A1 | 11/2001 | Appleton | |
| 2002/0070032 | A1 | 6/2002 | Maguire | |
| 2002/0170720 | A1 | 11/2002 | Haugen | |
| 2003/0066654 | A1 | 4/2003 | Juhasz | |
| 2003/0164276 | A1 | 9/2003 | Snider | |
| 2003/0173073 | A1 | 9/2003 | Snider | |
| 2004/0011531 | A1 | 1/2004 | Pietras | |
| 2004/0149451 | A1 | 8/2004 | Pietras | |
| 2004/0173357 | A1 | 9/2004 | Pietras | |
| 2004/0194965 | A1 | 10/2004 | Pietras | |
| 2004/0216924 | A1 | 11/2004 | Pietras | |
| 2004/0251050 | A1 | 12/2004 | Shahin | |
| 2004/0251055 | A1 | 12/2004 | Shahin | |
| 2004/0256110 | A1 | 12/2004 | York | |
| 2005/0000691 | A1 | 1/2005 | Giroux | |
| 2005/0006147 | A1 | 1/2005 | Ayling | |
| 2005/0211443 | A1 | 9/2005 | Helms | |
| 2005/0272507 | A1 | 12/2005 | Wenzel | |
| 2009/0114398 | A1 | 5/2009 | Buytaert | |

FOREIGN PATENT DOCUMENTS

| | | | |
|---|---|---|---|
| CA | 1 299 166 | C | 4/1992 |
| CA | 2 122 622 | C | 5/1993 |
| CA | 2 271 810 | A1 | 5/1998 |
| CA | 2 240 058 | A1 | 12/1999 |
| CA | 2 286 957 | A1 | 4/2000 |
| CA | 2 345 244 | A1 | 4/2000 |
| CA | 2 399 786 | A1 | 8/2001 |
| CA | 2 301 963 | A1 | 9/2001 |
| CA | 2 404 752 | A1 | 10/2001 |
| CA | 2 427 453 | A1 | 6/2002 |
| CA | 2 525 637 | A1 | 11/2004 |
| CA | 2 469 971 | A1 | 12/2004 |
| EP | 0 285 386 | A2 | 10/1988 |
| GB | 2 343 904 | A | 5/2000 |
| WO | 00/05483 | A1 | 2/2000 |
| WO | 00/11311 | A1 | 3/2000 |
| WO | 00/39430 | A1 | 7/2000 |
| WO | 01/59253 | A1 | 8/2001 |
| WO | 02/086279 | A1 | 10/2002 |
| WO | 2006/116870 | A1 | 11/2006 |

* cited by examiner

GRIP EXTENSION LINKAGE TO PROVIDE GRIPPING TOOL WITH IMPROVED OPERATIONAL RANGE, AND METHOD OF USE OF THE SAME

FIELD OF THE INVENTION

This invention relates intentionally to applications where tubulars and tubular strings must be gripped, handled and hoisted with a tool connected to a drive head or reaction frame to enable the transfer of both axial and torsional loads into or from the tubular segment being gripped. In the field of earth drilling, well construction and well servicing with drilling and service rigs this invention relates to slips, and more specifically, on rigs employing top drives, applies to tubular running tools that attach to the top drive for gripping the proximal segment of tubular strings being assembled into, deployed in or removed from the well bore. Such tubular running tools support various functions necessary or beneficial to these operations including rapid engagement and release, hoisting, pushing, rotating and flow of pressurized fluid into and out of the tubular string. This invention provides linkages to extend or improve the gripping range of such tubular running tools.

BACKGROUND OF THE INVENTION

Until recently, power tongs were the established method used to run casing or tubing strings into or out of petroleum wells, in coordination with the drilling rig hoisting system. This power tong method allows such tubular strings, comprised of pipe segments or joints with mating threaded ends, to be relatively efficiently assembled by screwing together the mated threaded ends (make-up) to form threaded connections between sequential pipe segments as they are added to the string being installed in the well bore; or conversely removed and disassembled (break-out). But this power tong method does not simultaneously support other beneficial functions such as rotating, pushing or fluid filling, after a pipe segment is added to or removed from the string, and while the string is being lowered or raised in the well bore. Running tubulars with tongs also typically requires personnel deployment in relatively higher hazard locations such as on the rig floor or more significantly, above the rig floor, on the so called 'stabbing boards'.

The advent of drilling rigs equipped with top drives has enabled a new method of running tubulars, and in particular casing, where the top drive is equipped with a so called 'top drive tubular running tool' to grip and perhaps seal between the proximal pipe segment and top drive quill. (It should be understood here that the term top drive quill is generally meant to include such drive string components as may be attached thereto, the distal end thereof effectively acting as an extension of the quill.) Various devices to generally accomplish this purpose of 'top drive casing running' have therefore been developed. Using these devices in coordination with the top drive allows hoisting, rotating, pushing and filling of the casing string with drilling fluid while running, thus removing the limitations associated with power tongs. Simultaneously, automation of the gripping mechanism combined with the inherent advantages of the top drive reduces the level of human involvement required with power tong running processes and thus improves safety.

In addition, to handle and run casing with such top drive tubular running tools, the string weight must be transferred from the top drive to a support device when the proximal or active pipe segments are being added or removed from the otherwise assembled string. This function is typically provided by an 'annular wedge grip' axial load activated gripping device that uses 'slips' or jaws placed in a hollow 'slip bowl' through which the casing is run, where the slip bowl has a frusto-conical bore with downward decreasing diameter and is supported in or on the rig floor. The slips then acting as annular wedges between the pipe segment at the proximal end of the string and the frusto-conical interior surface of the slip bowl, tractionally grip the pipe but slide or slip downward and thus radially inward on the interior surface of the slip bowl as string weight is transferred to the grip. The radial force between the slips and pipe body is thus axial load self-activated or 'self-energized', i.e., considering tractional capacity the dependent and string weight the independent variable, a positive feedback loop exists where the independent variable of string weight is positively fed back to control radial grip force which monotonically acts to control tractional capacity or resistance to sliding, the dependent variable. Similarly, make-up and break-out torque applied to the active pipe segment must also be reacted out of the proximal end of the assembled string. This function is typically provided by tongs which have grips that engage the proximal pipe segment and an arm attached by a link such as a chain or cable to the rig structure to prevent rotation and thereby react torque not otherwise reacted by the slips in the slip bowl. The grip force of such tongs is similarly typically self-activated or 'self-energized' by positive feed back from applied torque load.

In general terms, the gripping tool of PCT patent application CA 2006/00710 and U.S. national phase application Ser. No. 11/912,665, may be summarized as a gripping tool which includes a body assembly, having a load adaptor coupled for axial load transfer to the remainder of the body, or more briefly the main body, the load adaptor adapted to be structurally connected to one of a drive head or reaction frame, a gripping assembly carried by the main body and having a grip surface, which gripping assembly is provided with activating means to radially stroke or move from a retracted position to an engaged position to radially tractionally engage the grip surface with either an interior surface or exterior surface of a work piece in response to relative axial movement or axial stroke of the main body in at least one direction, relative to the grip surface. A linkage is provided acting between the body assembly and the gripping assembly which, upon relative rotation in at least one direction of the load adaptor relative to the grip surface, results in relative axial displacement of the main body with respect to the gripping assembly to move the gripping assembly from the retracted to the engaged position in accordance with the action of the activating means.

This gripping tool thus utilizes a mechanically activated grip mechanism that generates its gripping force in response to axial load or axial stroke activation of the grip assembly, which activation occurs either together with or independently from, externally applied axial load and externally applied torsion load, in the form of applied right or left hand torque, which loads are carried across the tool from the load adaptor of the body assembly to the grip surface of the gripping assembly, in tractional engagement with the work piece.

It will be apparent that the utility of this or other similar gripping tools is a function of the range of work piece sizes, typically expressed as minimum and maximum diameters for tubular work pieces, which can be accommodated between the fully retracted and fully extended grip surface positions of a given gripping tool, i.e., the radial size and radial stroke of the gripping surface. The utility of a given gripping tool can be improved if it can accommodate a greater range of work pieces sizes. The present invention is directed toward meeting this need in applications where greater radial size and radial stroke are beneficial such as often occurs when adapting gripping tools for running oilfield tubulars.

SUMMARY OF THE INVENTION

According to one aspect of the present invention there is provided a grip extension linkage to provide a gripping tool having radial gripping elements with an improved operational range. The grip extension linkage includes at least one annular body having a central internal bore and a peripheral external surface. There is provided rigid elongated spokes. Spoke guides are provided on the annular body. The spoke guides are in close fitting relation with the spokes to constrain the spokes while allowing them to move radially from a retracted position to an engaged position.

According to another aspect of the present invention there is a method in which the above described grip extension linkage is used to improve the operational range of the gripping tool having radial gripping elements. This involves positioning one of a work piece or a cylindrical gripping tool within the central internal bore of the at least one annular body and the other of the work piece or the cylindrical gripping tool around the peripheral external surface of the at least one annular body. This places the spokes in an annular space between the gripping elements of the gripping tool and the work piece. A first end of each of the spokes engages the gripping elements and a second end of each of the spokes either directly or indirectly engages the work piece. When the gripping elements of the gripping tool are moved radially to apply pressure on the first end of each of the spokes, the spokes moving radially from a retracted position to an extended position and act as radial extensions of the gripping elements of the gripping tool.

As noted above, the spokes can act either directly or indirectly upon the work piece. There will hereafter be further described a configuration in which the spokes indirectly engage the work piece. In that embodiment, slave gripping elements are positioned at a second end of each of the spokes. Radial movement of the gripping elements of the gripping tool are transferred via the spokes to the slave gripping elements.

As noted above, either the work piece or the gripping tool may be positioned within the central internal bore. When the work piece is positioned within the central internal bore, an interior surface of the gripping tool is positioned around the periphery of the body and the second end of each of the spokes directly or indirectly engage an exterior surface of the work piece. When the gripping tool is positioned within the central internal bore, an interior surface of the work piece is positioned around the periphery of the body and the second end of each of the spokes directly or indirectly engage the interior surface of the work piece.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DESCRIPTION OF THE PREFERRED EMBODIMENTS

General Principles

Figure 1:
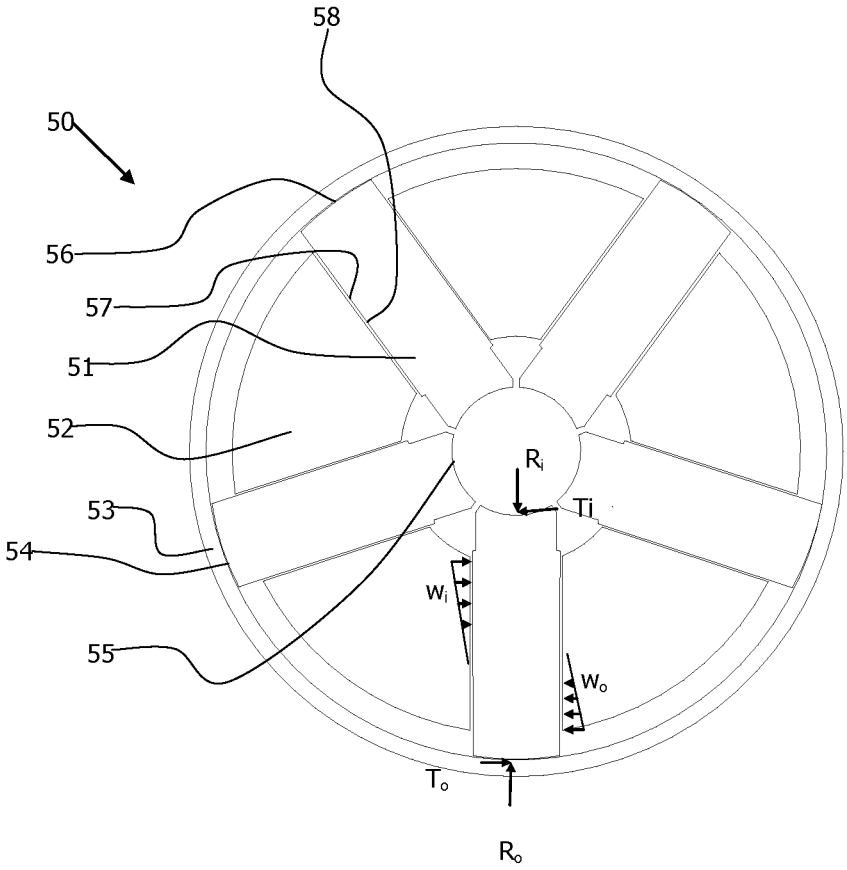
FIG. 1 is a schematic of a grip surface extension linkage located internal to a tubular work piece.

Referring now to FIG. 1 showing a schematic of a cross section through a radial plane of grip surface extension linkage 50 comprised of spokes 51 and spoke guides 52 shown as a plurality of elements disposed inside tubular work piece 53 and are understood to act together as a rigid body (attached to each other out of the two dimensional plane of view). Spokes 51 are arranged with extended grip surface 54 close fitting with tubular work piece 53 and gripping tool grip or interface surface 55. Force vectors as might typically be applied at gripping tool interface surface 55 by a gripping tool to apply torque through grip surface extension linkage 50 to work piece 53 and the resultant forces at grip surface 54, are shown on one spoke 51, where it will be apparent to one skilled in the art that the tangential force vectors "$T_i$" and "$T_o$" will most typically be less than the radial force vector "$R_i$" and "$R_o$" as required to meet typical frictional grip/work piece interfacial properties, and as such relatively short radial spokes will tend to be stable while relatively tall radial spokes may tend to roll and apply excessive prying loads as rolling is prevented by a radial non-uniform load distribution at interface 56 between the spoke 51 and work piece 53 and interface 55 between spoke 51 and gripping tool (not shown). To stabilize and prevent excessive radial prying loads, extension linkage 50 is provided with at least one rigid spoke guide 52 arranged to act between adjacent spokes 51 and providing a parallel guide contact face 57 at each spoke guide interface 58 that is sufficiently close fitting with spokes 51 and also sufficiently rigid such that any tendency of spoke 51 to roll will be prevented by contact with spoke guide interfaces 58 resulting in moment reaction contact stress illustrated by vectors "$w_i$" and "$w_o$" acting at radially inner and outer locations respectively, while guide contact face 57 is sufficiently smooth so as to facilitate radial sliding engagement at spoke guide interface 58 and to allow for radial motion of the spoke 51 under load and consequently allowing extended grip surface 54 to move radially and engage work piece 53. It will now be evident that grip surface extension linkage 50 provides a structure that transfers radial and torsional load from gripping tool interface 55 to extended grip surface 54 and prevents the tendency of spokes 51 to rotate or impose undue reaction moments at either spoke guide interface 58 or at the work piece 53 interface with extended grip surface 54.

Grip Surface Extension Linkage

Figure 2:
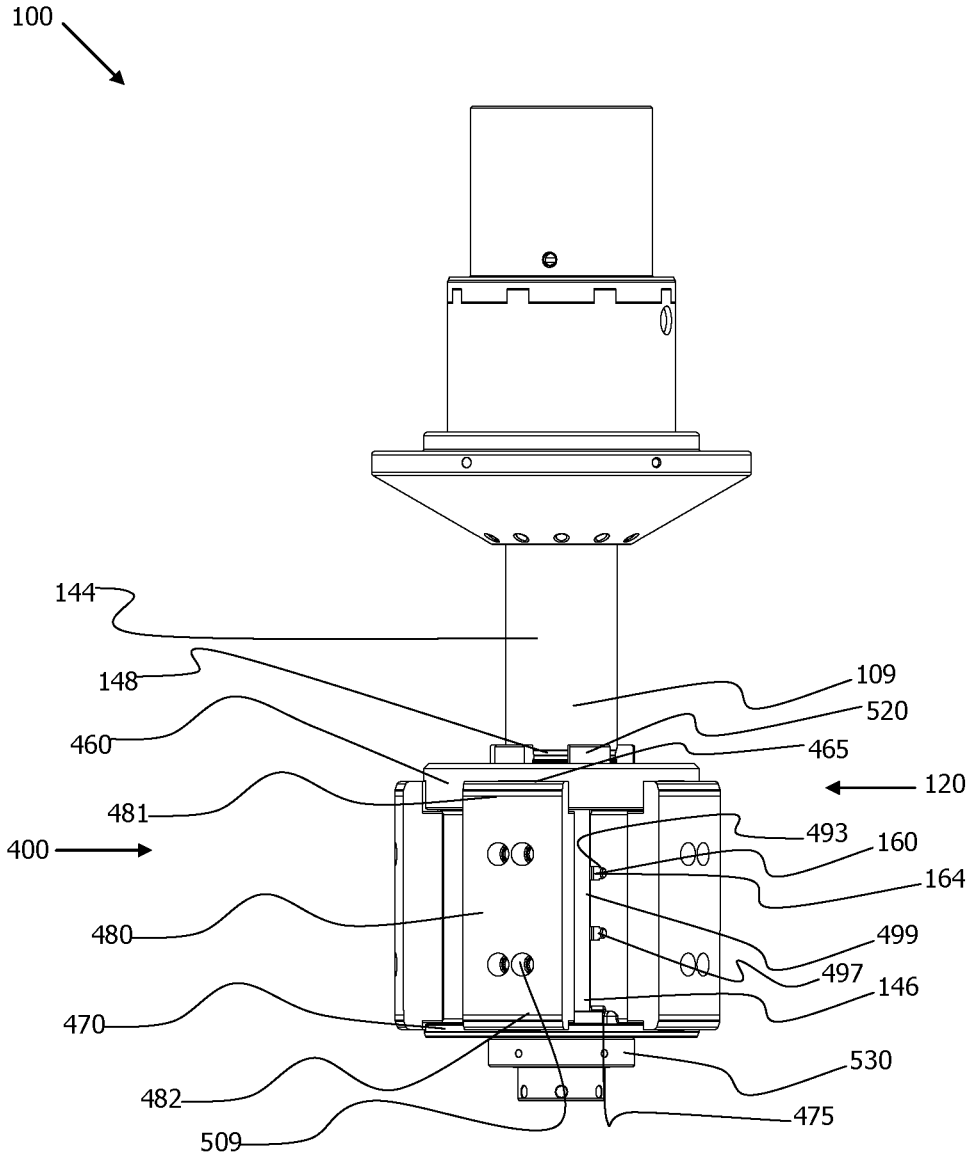
FIG. 2 is an external view of an internal grip tubular running tool with grip surface extension linkage assembly.
Figure 3:
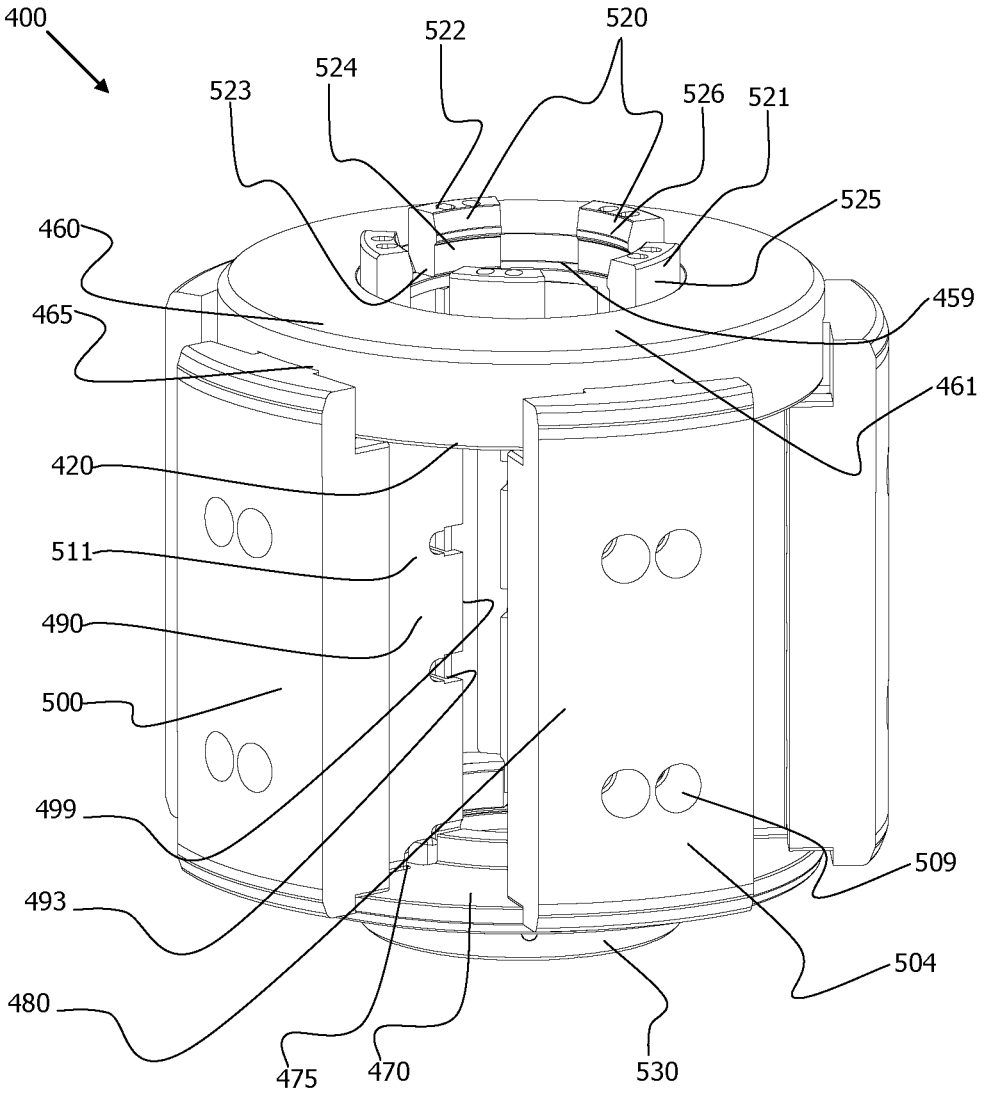
FIG. 3 is an external trimetric view of a grip surface extension linkage assembly.

Referring to FIGS. 2 through 8, there will now be described a preferred embodiment of the present invention referred to here as a grip surface extension linkage, previously described in principal with reference to FIG. 1. Referring first to FIG. 2, internal gripping tubular running tool 100 is shown configured with grip surface extension linkage assembly 400 adapted to mate with and be carried by lower end 109 of grip assembly 120. Assembly 400 is comprised of a plurality of radial oriented spokes 480 (shown here as five (5) matching the number of jaws 160), primary and secondary spoke guide plates 460 and 470 respectively, segmented retainer ring 520, and threaded retainer ring 530. Primary spoke guide plate 460 is coaxially located at the upper ends 481 of spokes 480 and similarly secondary spoke guide plate 470 is located at the lower ends 482 of spokes 480, where the spokes 480 engage with inward facing primary and secondary radial grooves, 465 and 475 respectively, provided in guide plates 460 and 470, respectively to thus form spoke guides as previously described with reference to FIG. 1. Referring still to FIG. 2, slots 497 can be provided for the placement of garter springs 507 (see FIG. 6 and FIG. 7) to facilitate spoke 480 refraction. Referring now to FIG. 3, showing a trimetric external view of grip surface extension linkage assembly 400 provided separate from the running tool, spokes 480 are provided as assemblies of radially inner web elements 490 rigidly connected to radially outer die elements 500 carrying extended grip surface 504 configured to engage with a work piece (not shown).

Figure 4:
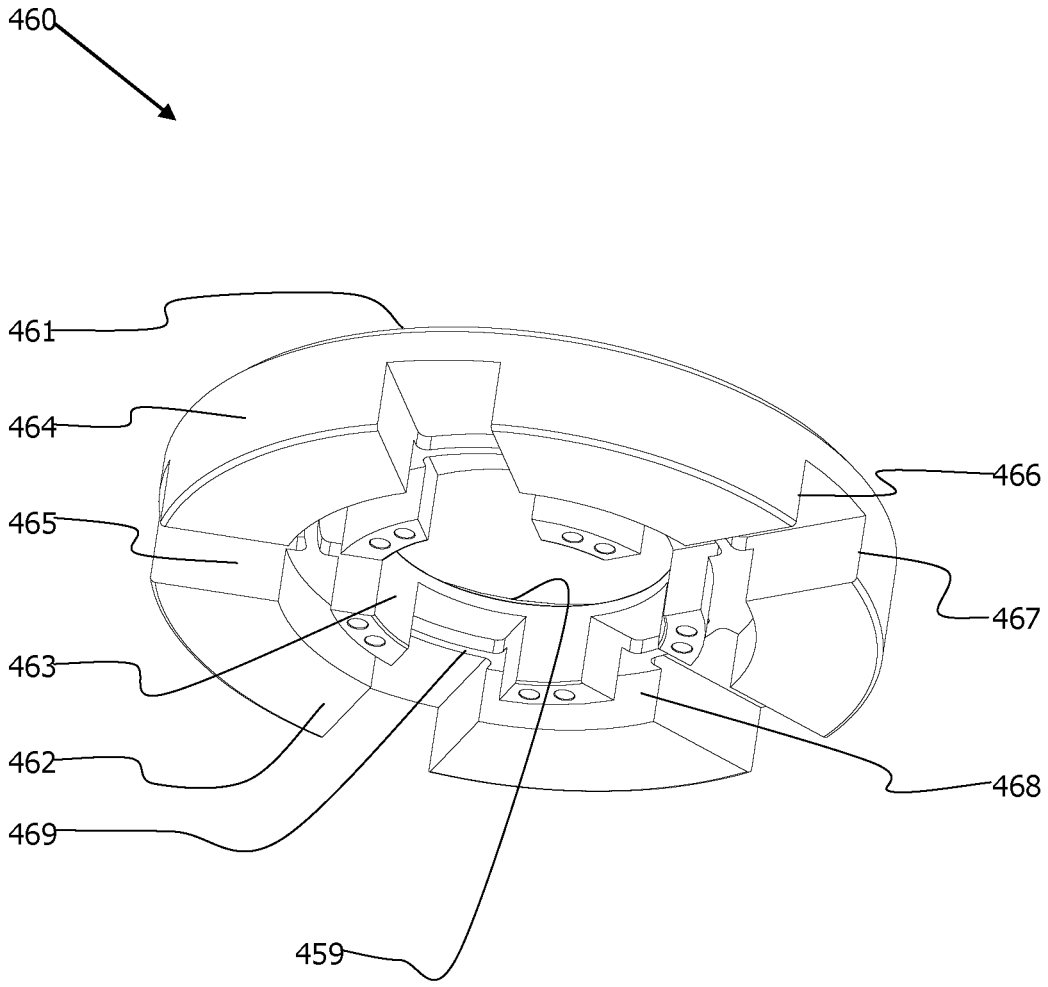
FIG. 4 is an external trimetric view of a primary guide plate.

Referring now to FIG. 4, which shows primary guide plate 460 in an external trimetric view, primary guide plate 460 has top end 461, bottom end 462, internal bore 463 and external surface 464. Primary guide plate 460 has a plurality of radial grooves 465, in this case five, each defined by load faces 466 and 467 on the bottom end 462 extending from internal bore 463 to external surface 464. Located adjacent to and concentric with internal bore 463 and at the bottom end 462 of guide plate 460 is garter spring groove 468 and stroke limit rib 469. On the top end 461 of guide plate 460 located concentric with and adjacent to internal bore 463 is retaining ring locating groove 459.

Referring again to FIG. 3, grip surface extension linkage assembly 400 is provided with a retainer ring 520 comprised of a plurality of retainer ring segments 521, in this case five, having upper face 522, lower face 523, inner face 524 and outer face 525. Retainer ring 520 is located adjacent to primary guide plate 460 such that lower face 523 mates with and is rigidly attached to retaining ring locating groove 459 on top face 461 of guide plate 460 by bolts (not shown). Inner face 524 of retainer ring 520 has internal upset section 526 designed to engage, referring now to FIG. 1, axial retention groove 148 to thus constrain relative axial movement of primary guide plate of 460 on gripping tool 100.

Figure 5:
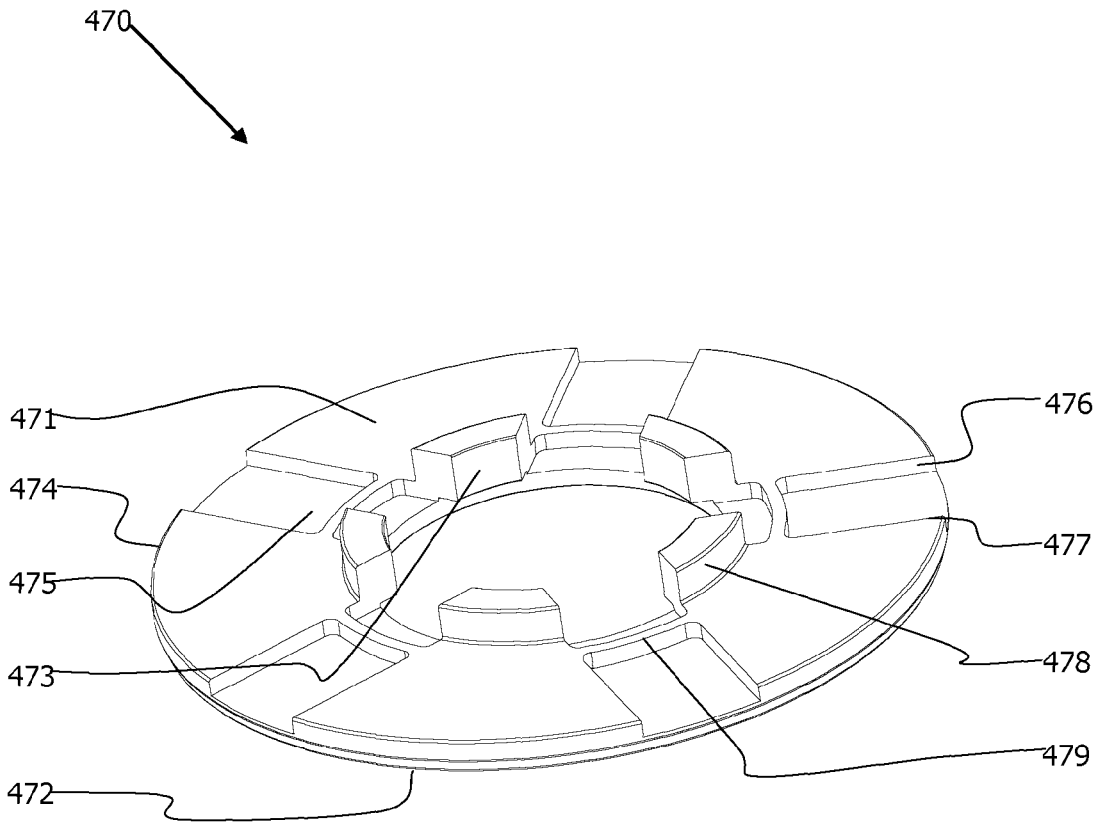
FIG. 5 is an external trimetric view of a secondary guide plate.

Referring now to FIG. 5, showing secondary guide plate 470 in an external trimetric view, having top end 471, bottom face 472, internal bore 473 and external surface 474. Secondary guide plate 470 has a plurality of radial grooves 475, in this case five, each defined by load faces 476 and 477 on the top end 471 extending from internal bore 473 to external surface 474. Located adjacent to and concentric with internal bore 473 and at the bottom end 472 of guide plate 470 is retaining spring guide shoulder 478 and stroke limit rib 479.

Figure 6:
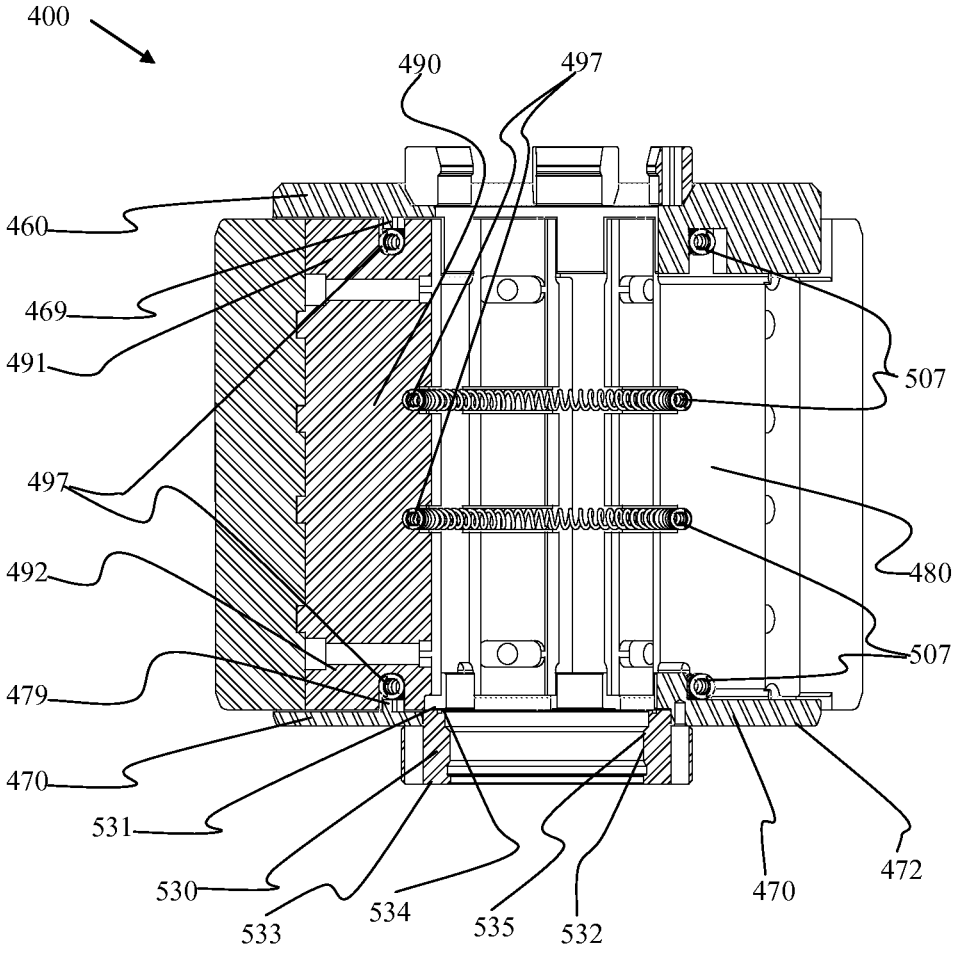
FIG. 6 is a cross section view of a grip surface extension linkage assembly.

Referring now to FIG. 6, showing a cross section view of assembly 400, threaded retainer ring 530 with top face 531, inside surface 532 and bottom face 533, has seal element 534 on top face 531 and thread element 535 on inside surface 532. Threaded retainer ring 530 is arranged concentrically with secondary guide plate 470 having thread element 535 designed to threadingly engage, referring now to FIG. 2, cage 144 of tubular running tool 100. Referring again to FIG. 6, top face 531 of ring 530 engages bottom face 472 of guide plate 470, thereby axially constraining relative downward movement of secondary guide plate 470 and grip surface extension linkage assembly 400.

Figure 7:
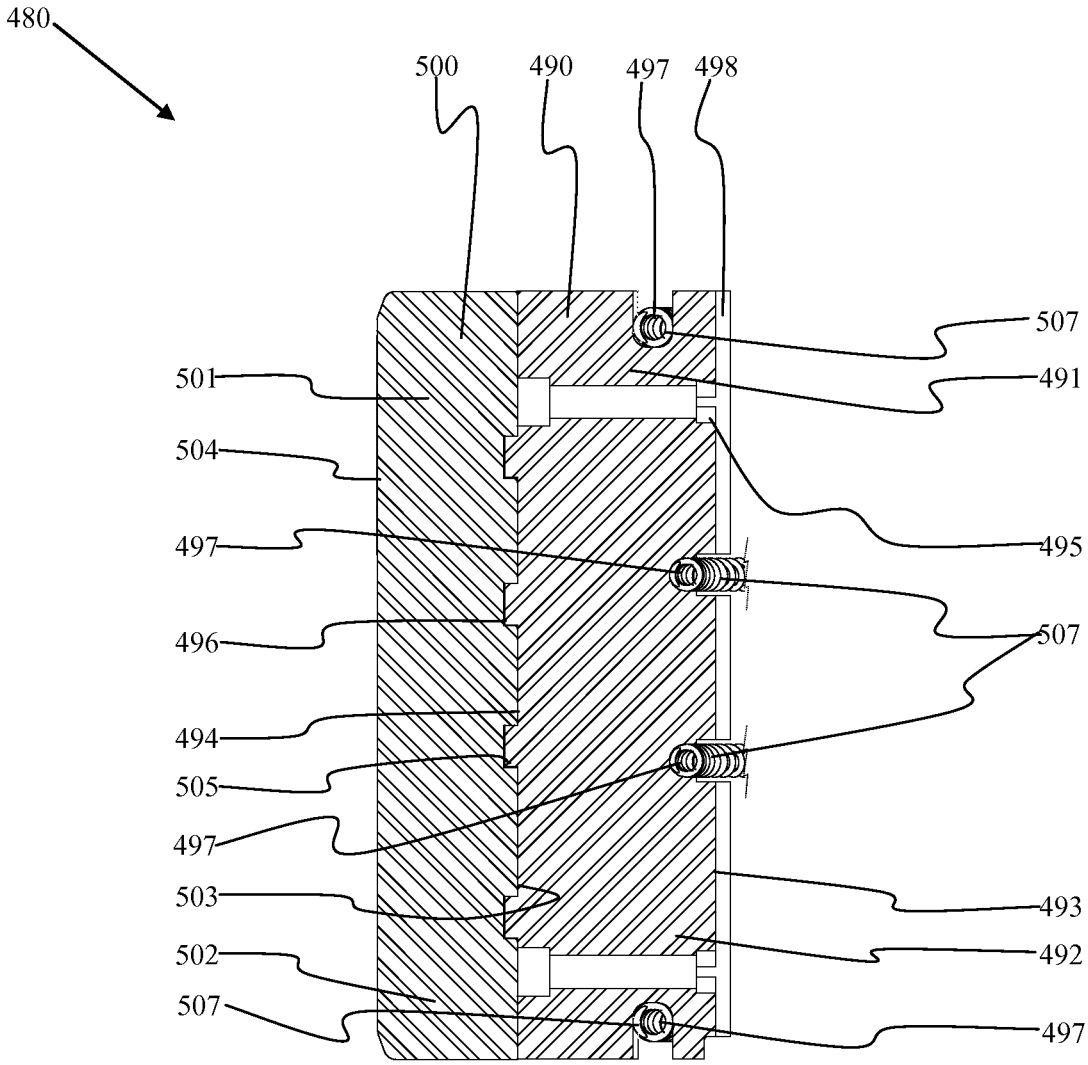
FIG. 7 is a cross section view of a spoke assembly.

Referring now to FIG. 7, a single spoke assembly 480 is shown in a section view, which in this embodiment of the present invention consists of web 490 and die 500. However, it is understood that the present invention is not limited to this arrangement. The number of spoke components may be selected as desired, to provide ease of manufacture, interchange of parts between sizes, component strength as required by and specifically relating to radial extent of die and length of circumferential overhang. Referring still to FIG. 7, generally elongate web 490 has top end 491, bottom end 492, internal surface 493, and external surface 494. External surface 494 is provided with a plurality of axial load lugs 496 generally arranged between the top end 491 and the bottom end 492, while internal surface 493 is provided with a plurality of axial load grooves 495 arranged between the top end 491 and bottom end 492. Web 490 has a plurality of circumferential retaining spring grooves 497, in this case four, located one at top end 491, one at bottom end 492 (both of which accommodate garter springs 507 that directly retains the web 490), and two located along internal surface 493 which provide clearance for additional garter springs that directly retain the jaw 160 of tubular running tool 100 (not shown), and two retaining lips 498, one on either side, axially oriented and extending between top end 491 and bottom end 492. The thickness of web 490 is generally governed by the thickness of jaw 160 and by the requirement to have some non-zero cage thickness between said jaw 160 while maximizing mandrel contact area.

Referring still to FIG. 7, die 500 with top end 501, bottom end 502, internal face 503 and external grip surface 504, has a plurality of laterally oriented axial retaining grooves 505 generally arranged on internal surface 503 between top end 501 and bottom end 502. Referring now to FIG. 3, die 500 is attached to web 490 by bolts (not shown) arranged in bolt holes 509. Referring now to FIG. 7, internal surface 503 of die 500 mates and interlocks with external surface 494 of web 490, such that axial retaining grooves 505 of die 500 engage axial load lugs 496 of web 490, and referring now to FIG. 8, which shows an axially oriented section view of grip surface extension linkage assembly 400, lateral retaining lips 506 of die 500 overhang and engage with lateral faces 511 of web 490 which collectively provide means to transfer axial, circumferential and radial load between web 490 and die 500. Referring now to FIG. 2, internal surface 493 of web 490 is designed to mate and interlock with the external gripping surface 164 of jaw 160 of tubular running tool 100 (not shown) and provide means to transfer load between the tubular running tool 100 and web 490 in a manner analogous to the load transfer between web 490 and die 500.

Referring again to FIG. 8, extended grip surface 504 of die 500 is generally configured with a friction enhancing surface (not shown) designed to provide a balance between surface penetration and friction characteristics and to provide a relatively large contact area to distribute radial contact load and consequently minimize deformation of work piece 401 while tractionally engaging internal surface 402 of work piece 401, and providing means to transfer axial, circumferential and radial load between die 500 and work piece 401.

Referring again to FIG. 6, stroke limit rib 469 and 479 on guide plate 460 and, 470 respectively act in conjunction with spring retaining grooves 497 on top end 491 and bottom end 492 of web 490 and function as rigid stops by engaging if spoke assemblies 480 move radially past the design stroke limit. Referring now to FIG. 3, spokes 480 of grip surface extension linkage assembly 400 are located axially between primary guide plate 460 and secondary guide plate 470 and aligned in guide grooves 465 and 475 respectively such that lateral faces 511 of web 490 slidingly engage said guide grooves and function to react lateral forces resultant on spoke assemblies 480 due to torsion applied to tubular running tool interface 499 on inner surface 493 of web 490 as previously described with reference to FIG. 1.

Figure 8:
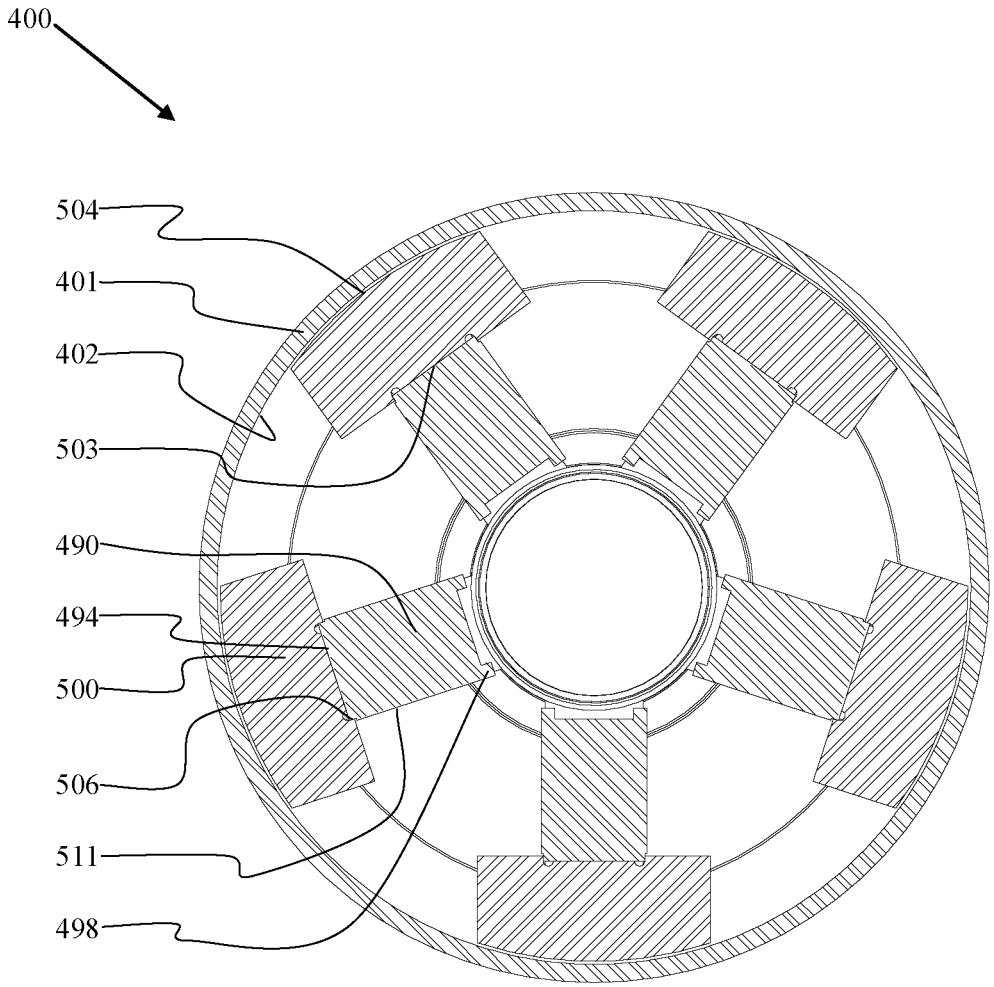
FIG. 8 is an axial cross section view of a grip surface extension linkage shown as it would appear located internal to and coaxially with a work piece.

Referring again to FIG. 2, grip surface extension linkage assembly 400 is located external to and co-axial with tubular running tool 100, where gripping tool interface surfaces 499 of spokes 480 are engaged with the gripping surface 164 of jaws 160 of the grip assembly 120 and where spokes 480 can be circumferentially aligned with the jaws of tubular running tool 100. It is understood also that the number of spokes 480 can be equal to the number of jaws 160 on the tubular running tool 100. Referring now to FIG. 8, it will be apparent to one skilled in the art that the grip surface extension linkage is not necessarily associated with or attached to a specific tubular running tool, and as such said linkage assembly 400 can be provided with an integral link between primary and secondary guide plates 460 and 470 respectively to prevent relative axial movement but allow some relative rotation of each guide plate about the axis of linkage assembly 400. In this case assembly 400 can be provided a means of axial retention in a work-piece 401 such that the grip surface extension linkage assembly 400 would first be inserted into said work-piece and to grip said work-piece, a tubular running tool (not shown) would subsequently be inserted into the grip surface extension linkage assembly 400 and activation of said tubular running tool would activate the grip surface extension linkage assembly 400. It will be apparent that an arrangement such as this might be beneficial in an application where multiple work-pieces of different sizes were being gripping in quick succession.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A grip extension linkage combination, comprising:

a gripping tool having axial load or stroke activated radial gripping elements;

a grip extension linkage, the grip extension linkage comprising:

at least one annular body having a central internal bore and a peripheral external surface;

rigid elongated spokes in contact with the radial gripping elements of the gripping tool on a first side and carrying an extended grip surface on a second side opposing the first side; and spoke guides on the at least one annular body, the spoke guides being in close fitting relation with the spokes to constrain the spokes from axial rotation or rolling while allowing them to move radially from a retracted position to an engaged position in response to movement of the radial gripping elements of the gripping tool.

2. The grip extension linkage combination of claim 1, wherein the at least one annular body includes an upper annular plate and a lower annular plate.

3. The grip extension linkage combination of claim 2, wherein the spokes are sandwiched between the upper annular plate and the lower annular plate.

4. The grip extension linkage combination of claim 1, wherein slave gripping elements are mounted at one end of each of the spokes.

5. The grip extension linkage combination of claim 1, wherein there is a stroke limiting stop between each of the spokes and the spoke guides.

6. The grip extension linkage combination of claim 1, wherein the spokes are biased by springs into the retracted position.

7. The grip extension linkage combination of claim 1, wherein the grip extension linkage is carried by the gripping tool, and wherein the radial gripping elements, spokes, and grip surface are combined as a rigid body having the first side and the second side, the radial gripping elements of the gripping tool on the first side being an axial load activated jaw.

8. The grip extension linkage combination of claim 7, wherein the at least one annular body includes an upper annular plate and a lower annular plate.

9. The grip extension linkage combination of claim 8, wherein the spokes are sandwiched between the upper annular plate and the lower annular plate.

10. The grip extension linkage combination of claim 7, wherein slave gripping elements are mounted at one end of each of the spokes.

11. The grip extension linkage combination of claim 7, wherein the rigid body is capable of torque transmission in the absence of axial load.

12. The grip extension linkage combination of claim 1, wherein the radial gripping elements are mechanically activated by a combination of axial load or stroke activation and torque activation in at least one rotational direction.

13. A method of improving the operational range of a gripping tool, comprising:

providing a grip extension linkage, comprising:

at least one annular body having a central internal bore and a peripheral external surface;

rigid elongated spokes; and spoke guides on the at least one annular body, the spoke guides being in close fitting relation with the spokes to constrain the spokes while allowing them to move radially from a retracted position to an engaged position;

positioning one of a work piece or a cylindrical gripping tool within the central internal bore of the at least one annular body and the other of the work piece or the cylindrical gripping tool around the peripheral external surface of the at least one annular body, with the spokes being disposed in an annular space between the gripping elements of the gripping tool and the work piece, with a first end of each of the spokes engaging the gripping elements and a second end of each of the spokes either directly or indirectly engaging the work piece; and moving the gripping elements of the gripping tool radially to apply pressure on the first end of each of the spokes, the spokes moving radially from a retracted position to an extended position and acting as radial extensions of the gripping elements of the gripping tool.

14. The method of claim 13, wherein the spokes indirectly engage the work piece, slave gripping elements being positioned at a second end of each of the spokes, wherein radial movement of the gripping elements of the gripping tool is transferred via the spokes to the slave gripping elements.

15. The method of claim 13, wherein the work piece is positioned within the central internal bore of the at least one annular body, an interior surface of the gripping tool is positioned around the periphery of the at least one annular body, and the second end of each of the spokes directly or indirectly engages an exterior surface of the work piece.

16. The method of claim 13, wherein the gripping tool is positioned within the central internal bore of the at least one annular body, an interior surface of the work piece is positioned around the periphery of the at least one annular body, and the second end of each of the spokes directly or indirectly engages an interior surface of the work piece.

17. A method of improving the operational range of a gripping tool, comprising:

providing a gripping tool having axial load or stroke activated radial gripping elements;

providing a grip extension linkage, comprising:

at least one annular body having a central internal bore and a peripheral external surface;

rigid elongated spokes; and spoke guides on the at least one annular body, the spoke guides being in close fitting relation with the spokes to constrain the spokes while allowing them to move radially from a retracted position to an engaged position;

positioning one of a work piece or a cylindrical gripping tool within the central internal bore of the at least one annular body and the other of the work piece or the cylindrical gripping tool around the peripheral external surface of the at least one annular body, with the spokes being disposed in an annular space between the gripping elements of the gripping tool and the work piece, with a first end of each of the spokes engaging the gripping elements and a second end of each of the spokes either directly or indirectly engaging the work piece;

applying an axial load or stroke to move the gripping elements of the gripping tool radially such that the gripping elements apply pressure on the first end of each of the spokes, the spokes moving radially from a retracted position to an extended position and acting as radial extensions of the gripping elements of the gripping tool.

18. The method of claim 17, wherein the spokes indirectly engage the work piece, slave gripping elements being positioned at a second end of each of the spokes, wherein radial movement of the gripping elements of the gripping tool is transferred via the spokes to the slave gripping elements.

19. The method of claim 17, wherein the work piece is positioned within the central internal bore of the at least one annular body, an interior surface of the gripping tool is positioned around the periphery of the at least one annular body, and the second end of each of the spokes directly or indirectly engages an exterior surface of the work piece.

20. The method of claim 17, wherein the gripping tool is positioned within the central internal bore of the at least one annular body, an interior surface of the work piece is positioned around the periphery of the at least one annular body, and the second end of each of the spokes directly or indirectly engages an interior surface of the work piece.

* * * * *